United States Patent [19]

LaBarge et al.

[11] Patent Number: 4,842,133

[45] Date of Patent: Jun. 27, 1989

[54] CHESS EQUIPMENT CARRYING BAG

[76] Inventors: Beverly C. LaBarge; Daniel C. LaBarge, both of 183 Lake Ave., Saratoga Springs, N.Y. 12866

[21] Appl. No.: 140,599

[22] Filed: Mar. 29, 1988

[51] Int. Cl.[4] ..... A45C 11/00; A45C 13/30

[52] U.S. Cl. ..... 206/315.1; 206/579; 190/102; 190/109

[58] Field of Search ..... 206/315.1, 579, 570, 206/581, 828, 810; 273/260, 285, 286; D3/71, 76; 190/102, 109, 111

[56] References Cited

U.S. PATENT DOCUMENTS

| | | | |
|---|---|---|---|
| D. 256,522 | 8/1980 | Peterson | D3/76 X |
| D. 270,586 | 9/1983 | Tatnall et al. | D3/71 X |
| 968,479 | 8/1910 | Jensen | 273/286 X |
| 1,269,276 | 6/1918 | Harris | 206/579 X |
| 1,549,610 | 8/1925 | Reisz | 273/285 |
| 2,221,267 | 11/1940 | Robertson | 273/285 |
| 2,667,353 | 1/1954 | Lanice | 273/286 |
| 2,825,208 | 3/1958 | Anderson | 206/581 X |
| 3,880,429 | 4/1975 | Blumenaus | 273/285 X |
| 3,948,528 | 4/1976 | Goodman, Jr. et al. | 273/286 |
| 4,119,181 | 10/1978 | Jones | 190/107 |
| 4,154,339 | 5/1979 | Dutra | 206/315.1 |
| 4,169,550 | 10/1979 | Williams | 206/570 X |
| 4,209,085 | 6/1980 | Kozan | 206/315.1 X |
| 4,241,833 | 12/1980 | Luebcke | 206/570 |
| 4,422,645 | 12/1983 | Simons | 206/315.1 X |
| 4,429,793 | 2/1984 | Ehmann | 206/828 X |
| 4,461,332 | 7/1984 | Parkhurst | 206/581 X |
| 4,480,774 | 11/1984 | Smith et al. | 206/315.1 X |
| 4,513,974 | 4/1985 | Lin | 206/579 X |
| 4,569,082 | 2/1986 | Ainsworth et al. | 206/581 X |

FOREIGN PATENT DOCUMENTS

| | | | |
|---|---|---|---|
| 3334246 | 4/1985 | Fed. Rep. of Germany | 206/828 |
| 2223956 | 10/1974 | France | 273/286 |
| 2562434 | 10/1985 | France | 273/286 |
| 700150 | 12/1979 | U.S.S.R. | 273/260 |
| 1163871 | 6/1985 | U.S.S.R. | 273/260 |

*Primary Examiner*—Sue A. Weaver

[57] ABSTRACT

A fabric bag for carrying and storing chess equipment comprising of two external strap carrying handles, a single external zipper longitudinally enabling the bag to be completely closed or when open to lie flat on a surface, two internal zippered pockets attached to one side at opposite ends for the storage of game pieces, two internal hook and loop (VELCRO R) straps attached to one side above the pockets for the securing of a rolled flexible playing board, two internal hook and loop (VELCRO R) straps attached to one side between the zippered pockets for the securing of a tournament chess clock and having all non-zippered sides internally padded.

4 Claims, 2 Drawing Sheets

CHESS EQUIPMENT CARRYING BAG

BACKGROUND OF THE INVENTION

Tournament chess players had a need for a device that enabled them to carry and store all of their tournament chess equipment (set, board, clock) in a convenient manner, while offering a large degree of protection to that equipment while in transit or storage. This invention was designed to meet those needs in the most astute, compact, secure, convenient, portable, practical, lightweight, and aesthetic manner.

SUMMARY

This invention relates to a fabric bag for the carrying and storing of the equipment required to play tournament games of chess, i.e. the chess board, the chess pieces, and the chess clock.

The advantages of this invention are that it serves as a compact carrying unit as well as a means of storing and protecting the chess equipment when not in use.

DESCRIPTION OF THE PREFERRED EMBODIMENT

Figure 1:
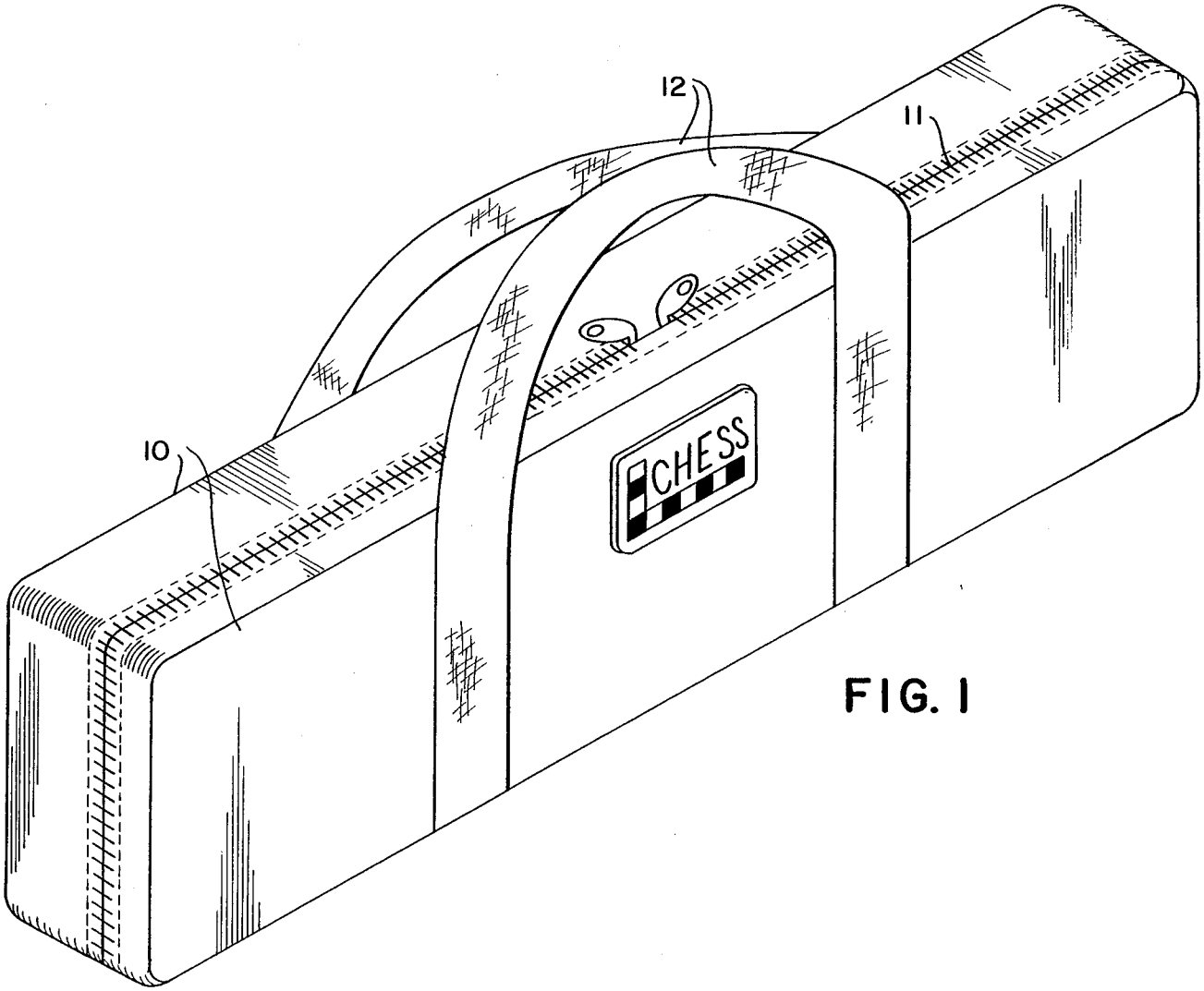
FIG. 1 is an isometric view of the bag invention.

Referring to the drawings wherein like reference characters designate similar elements throughout the views.

Figure 2:
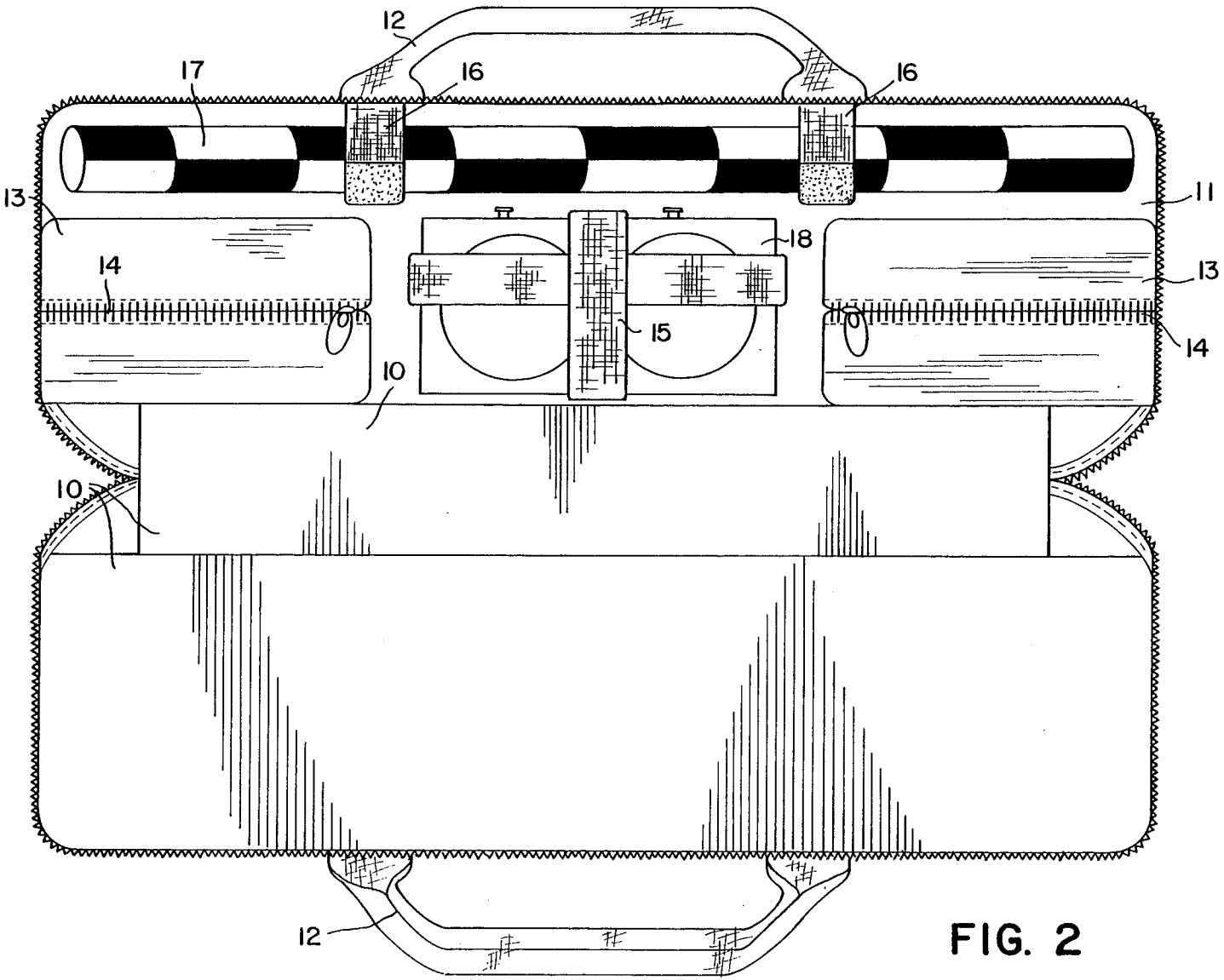
FIG. 2 is an overhead view of the interior of the bag invention.

FIG. 1 illustrates the external view ot the bag showing the position of the nylon strap carrying handles (12), the off center zipper(11), that holds the bag closed and two of the three padded sides (10). FIG. 2 illustrates an overhead view of the opened bag, the interior lay out of the bag, the two zippered (14) pockets (13) for the containment of the chess pieces, the crossing hook and loop (VELCRO R) straps (15) that hold the chess clock (18) and the two hook and loop (VELCRO R) straps (16) that hold a rolled chess board (17), the three padded sides (10) able to be enclosed by zipper (11) and carried by the two nylon carrying handles (12).

The entire bag invention is constructed of man-made fabric and sewn by methods common to the bag construction industry.

Let it be known that this disclosure, now under consideration, is presented as an example only and future modifications of construction or arrangement of components may be made without voiding the spirit or scope of invention claimed below.

We claim:

1. A chess equipment carrying bag comprising hollow, rectangular first and second fabric casing sections, said casing sections each including a rectangular peripheral side wall defined by opposed end portions and opposed front and back portions, said hollow first section being of less depth than said second section, said second section connected to said first section by a zipper means, said hollow second section including zippered pockets at each end portion thereof for holding chess pieces, attachment means located between said zippered pockets for holding a chess clock, and holding means for storing a rolled up fabric chess board located above said zippered pockets adjacent said front portion.

2. The bag claimed in claim 1, wherein the hollow first and second sections include padding means.

3. The bag claimed in claim 1, wherein the attachment means comprises hook and loop straps to secure various sized chess clocks.

4. The bag claimed in claim 1 wherein the holding means comprises hook and loop straps.

* * * * *